US008146301B2

(12) United States Patent
Bystricky et al.

(10) Patent No.: US 8,146,301 B2
(45) Date of Patent: Apr. 3, 2012

(54) METHOD OF FORMING A BUCKLING RESTRAINED BRACE FOR STRUCTURAL REINFORCEMENT AND SEISMIC ENERGY DISSIPATION

(75) Inventors: Pavel Bystricky, Lexington, MA (US); Jerome P. Fanucci, Lexington, MA (US)

(73) Assignee: Kazak Composites, Inc., Woburn, MA (US)

( * ) Notice: Subject to any disclaimer, the term of this patent is extended or adjusted under 35 U.S.C. 154(b) by 0 days.

(21) Appl. No.: 12/725,852

(22) Filed: Mar. 17, 2010

(65) Prior Publication Data

US 2011/0167638 A1 Jul. 14, 2011

Related U.S. Application Data

(62) Division of application No. 11/725,582, filed on Mar. 19, 2007, now Pat. No. 7,707,788.

(51) Int. Cl.
*E04B 1/98* (2006.01)

(52) U.S. Cl. ..... 52/167.3; 52/167.1

(58) Field of Classification Search ..... 52/167.1, 52/167.3; 148/639, 640, 714; 248/901; 29/447
See application file for complete search history.

(56) References Cited

U.S. PATENT DOCUMENTS

| | | | | |
|---|---|---|---|---|
| 5,799,924 | A | 9/1998 | Slocum et al. | |
| 6,530,182 | B2 | 3/2003 | Fanucci et al. | |
| 6,701,680 | B2 | 3/2004 | Fanucci et al. | |
| 6,820,924 | B2 | 11/2004 | Caliskan et al. | |
| 6,918,224 | B2 | 7/2005 | Tjoelker et al. | |
| 6,994,350 | B2 * | 2/2006 | Krajewski et al. | 296/187.03 |
| 7,174,680 | B2 | 2/2007 | Smelser | |
| 7,185,462 | B1 | 3/2007 | Smelser | |
| 7,188,452 | B2 | 3/2007 | Sridhara | |
| 2003/0222188 | A1 | 12/2003 | Smelser et al. | |
| 2005/0005539 | A1 | 1/2005 | Nakamura et al. | |
| 2005/0108959 | A1 | 5/2005 | Powell et al. | |
| 2005/0257490 | A1 | 11/2005 | Pryor et al. | |
| 2006/0101733 | A1 | 5/2006 | Jen et al. | |
| 2007/0056225 | A1 | 3/2007 | Takeuchi et al. | |

OTHER PUBLICATIONS

"Capitol Steel Corporation Glossary." Capitol Street. Mar. 19, 2009. <http://www.capitolsteel.com.ph/glossary.html>.

Ronald L. Mayes et al., Comparative Performance of Buckling-Restrained Braces and Moment Frames: 13th World Conference on Earthquake Engineering; Vancouver, B.C., Canada; Aug. 1-6, 2004; Paper No. 2887.

"yieled, v." Oxford English Dictionary. Mar. 19, 2009. <http://dictionary.oed.com/cgi/entry/50289721?query_type=word&queryword=yield&first=1&max_to_show=10&sort_type=alpha&search_id=15Fv-cAq0z1-12697&result_place=2>.

* cited by examiner

*Primary Examiner* — Branon Painter
(74) *Attorney, Agent, or Firm* — Weingarten, Schurgin, Gagnebin & Lebovici LLP

(57) ABSTRACT

A buckling restrained brace includes a deformable core contained within an outer casing. Ends of the core protrude from the casing for connection to a frame or other structure. A length of the deformable core between its ends, referred to as the gauge or yielding section, is capable of deforming during an earthquake or blast loading. The gauge section is differentially heat treated from the ends so that the gauge section has a lower yield strength than the ends. The casing provides containment of the core to prevent buckling of the core. A metal foil interface or unbonding layer is provided between the deformable core and the casing so that the deformable core does not bind to the casing. The buckling restrained brace provides significant performance improvements over prior art BRBs coupled with simplified assembly.

11 Claims, 8 Drawing Sheets

METHOD OF FORMING A BUCKLING RESTRAINED BRACE FOR STRUCTURAL REINFORCEMENT AND SEISMIC ENERGY DISSIPATION

CROSS REFERENCE TO RELATED APPLICATIONS

This application is a division of and claims priority under 35 U.S.C. §120 of U.S. patent application Ser. No. 11/725,582, filed on Mar. 19, 2007, the disclosure of which is incorporated by reference herein.

STATEMENT REGARDING FEDERALLY SPONSORED RESEARCH OR DEVELOPMENT

This invention was made under Department of the Army SBIR Contract # DACA42-02-C-0008. The government has certain rights in this invention.

BACKGROUND OF THE INVENTION

During an earthquake or a blast from an explosion, a building is subjected to cyclic loading in the form of repeated tensile and compressive forces. Buckling restrained braces (BRBs), also known as unbonded braces, are finding acceptance as structural elements that add reinforcement and energy dissipation to steel frame buildings to protect the buildings against large deformations induced by earthquakes or blasts from explosions. The brace is designed to yield in tension or compression while resisting buckling.

A prior art BRB employs a steel core and a steel casing. The steel core has a yielding segment, typically provided by a narrowed or necked region. The casing prevents buckling of the core. Concrete or mortar fills the space between the core and the casing. The core cannot bond to the casing, so an unbonding layer, such as a TEFLON layer, may be applied over the core.

The buckling restrained brace absorbs seismic energy while mitigating inter-story drift. Performance-based design of earthquake resistant buildings requires technologies that can simultaneously minimize inter-story drift and floor accelerations. While inter-story drift is always taken into account by design engineers, protection against floor accelerations is often overlooked. Inter-story drift causes damage to a building's framing, façade and windows. Floor acceleration causes damage to ceilings, electrical systems, elevators, and building contents in general. Viscous and hysteretic dampers are technologies which provide energy dissipation with the ability to greatly reduce inter-story drift, but with minimal impact on reducing floor accelerations. BRBs, on the other hand, provide both energy dissipation and added stiffness with the ability to deform plastically, thereby reducing both inter-story drift and floor accelerations. The more powerful the earthquake, the greater the inter-story drift—and thus the greater the brace displacement—that needs to be accommodated. The extent to which floor accelerations may be mitigated depends on the brace's yield strength.

Advantages of BRBs over conventional braced frames include smaller beam and foundation design, control of member stiffness, greater energy dissipation, and reduced post-earthquake maintenance. The added cost of BRBs (such as additional development, materials, and transportation) may therefore be offset by savings in foundation and overall frame design. Current market trends seem to be moving away from damping and toward higher stiffness and very high purchased BRB capacities, from 200 kips at the low end to greater than 1000 kips.

SUMMARY OF THE INVENTION

A buckling restrained brace (BRB) is provided with extremely high strain capability, and thus the ability to mitigate powerful earthquakes by accommodating and absorbing large inter-story drifts, and with the ability to tailor yield strength to a particular application. When compared to prior art steel BRBs, the present BRBs have demonstrated much higher drift performance and, through the use of an aluminum deforming core, superior acceleration performance. Methods of producing the BRBs are also provided.

One embodiment of a buckling restrained brace includes a deformable core, such as a solid rod or bar, contained within a casing. The ends of the core protrude from the casing, so that the brace can be connected to a frame or other structure. A length of the deformable core between its ends, referred to as the gauge or yielding section, is capable of deforming plastically during an earthquake or blast loading. The gauge section is rendered weaker than the ends so that the gauge section has a lower yield strength than the ends. This can be accomplished by differentially heat treating (softening or overaging) the gauge section while keeping the ends heat insulated or by differentially heat treating (age-hardening) the ends of the deformable core while keeping the gauge section heat insulated. Additionally, the cross-sectional area of the gauge section relative to the ends may be reduced. The stronger ends connected to a structure do not fail during an earthquake or blast, while the gauge section yields. The casing or shell, such as a one-piece cylinder that can slide over the deformable core, provides containment of the core to prevent buckling of the core. A metal foil interface or other unbonding layer between the deformable core and the outer casing is provided so that the deformable core does not bind to the outer shell, and thus does not transfer axial load to the outer shell, while still being sufficiently constrained to prevent buckling. A filler material may optionally be provided between the core and the casing if desired.

DESCRIPTION OF THE DRAWINGS

The invention will be more fully understood from the following detailed description taken in conjunction with the accompanying drawings in which.

DETAILED DESCRIPTION OF THE INVENTION

The disclosure of U.S. patent application Ser. No. 11/725,582, filed on Mar. 19, 2007, is incorporated by reference herein.

Figure 1:
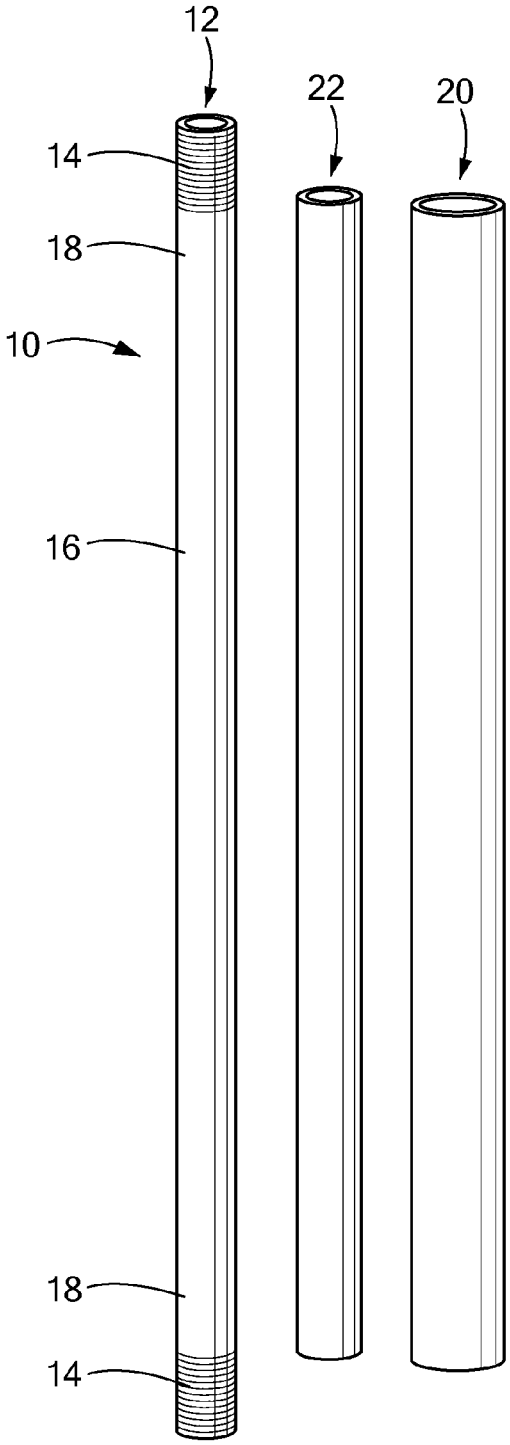
FIG. 1 is an exploded view of an embodiment of a buckling restrained brace (BRB) according to the present invention.
Figure 2:
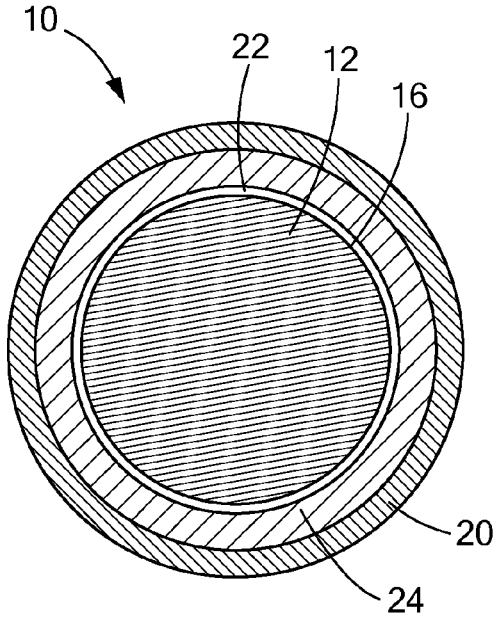
FIG. 2 is a cross sectional view of the buckling restrained brace of FIG. 1 in an assembled configuration.

Referring to FIGS. 1 and 2, a buckling restrained brace 10 of the present invention includes a deformable core 12, such as a solid rod or bar. Ends 14 of the core are connectable to another structure. An intermediate portion of the deformable core between the ends, referred to as the gauge or yielding section 16, is capable of deforming plastically during an earthquake or blast loading. The gauge section is preferably at least 80 to 90% of the total length of the core including the ends, although a lesser length gauge section may be provided. A transition segment 18 may be present between the gauge section and the ends or connections. The ends are stronger than the gauge section so that the connections to the structure do not fail during the earthquake or blast. A casing or shell 20, such as a one-piece cylinder that can slide over the deformable core, provides containment of the core to prevent buckling of the core. The casing is preferably formed of steel. An interface or unbonding layer 22 between the deformable core and the outer casing is provided so that the deformable core does not bind to the outer casing.

Figure 3:
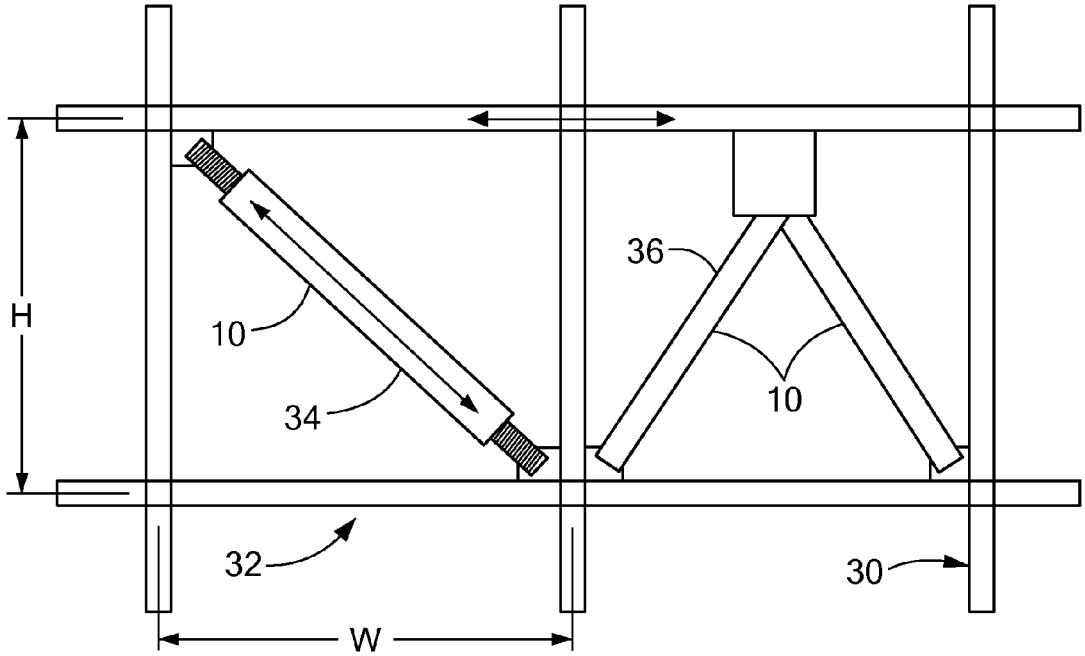
FIG. 3 is a schematic illustration of a frame incorporating a BRB as a diagonal strut and in a chevron brace arrangement.

The ends 14 of the core protrude from the casing, so that the brace can be connected to a frame or other structure 30, illustrated in FIG. 3. The ends can be connected in any suitable manner, such as by a threaded attachment (illustrated in FIG. 1), bolts, pins, welds, screws, rivets, press fit, interference fit, a machined attachment fitting, or other known fastening mechanisms. Referring to FIG. 3, a brace or braces 10 may span a building frame bay 32 composed of beams of width W and columns of height H either as a diagonal strut 34 or via a chevron brace arrangement 36.

The unbonding layer 22 prevents interference between the outer protective casing 20 and the inner deformable core 12 while still allowing the core to be protected from buckling, barreling, or any other type of non-uniform deformation when subjected to compressive loading. In one embodiment, metal foil is rolled around the inner deformable core to form one or more layers between the core and the outer casing, thereby filling an appropriate fraction of the corresponding gap. Metal foil has been found to be more effective than grease or other materials used in the prior art for this purpose, particularly for its stability over time. In one exemplary embodiment, a layer of aluminum foil 12 mils thick was wrapped about the core. Other films or foils such as PTFE (such as TEFLON®) or other lubricant solid layered structures can also be used.

The core 12 may fill varying fractions of the overall volume within the casing 20. The core outer surface and/or edges may or may not extend to within the immediate proximity of the casing's inside wall. In another embodiment, the space 24 between the core and the casing may optionally be filled with a filler material such as concrete, grout, foam, or composite material. The filler material can allow a reduction in the thickness of the outer casing, resulting in a cost savings, as less casing material such as steel is used.

Figure 4:
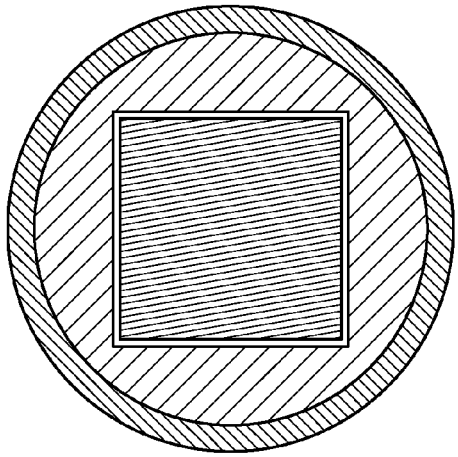
FIG. 4 is a cross sectional view of a BRB with a core having a square cross section.
Figure 5:
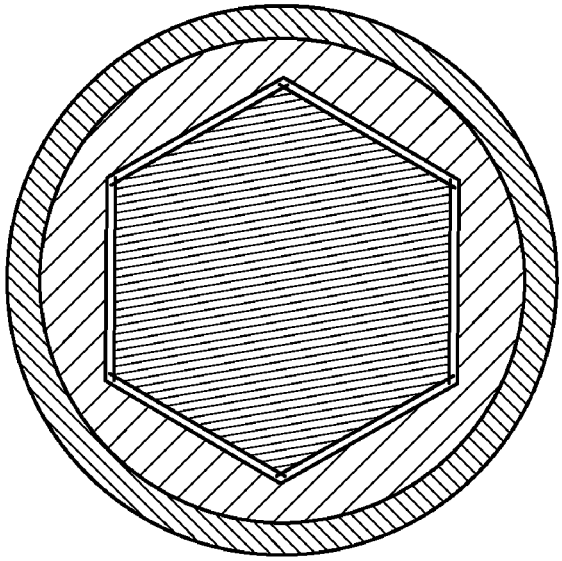
FIG. 5 is a cross sectional view of a BRB with a core having a hexagonal cross section.
Figure 6:
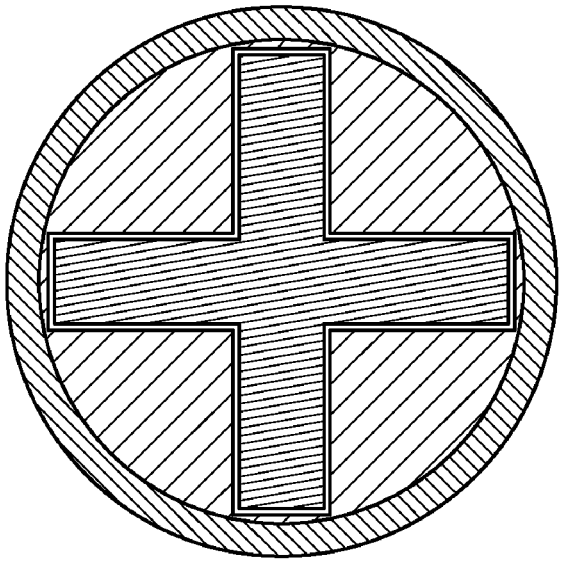
FIG. 6 is a cross sectional view of a BRB with a core having a cruciform cross section.

The gauge section 16 of the core 12 may have any desired cross sectional configuration, such as circular (FIG. 2), square (FIG. 4), rectangular (not shown), pentagonal (not shown), hexagonal (FIG. 5), cruciform (FIG. 6), or ring-shaped (not shown). The cross section of the gauge section can differ from the cross section of the ends, in which case a suitable transition between the gauge section and the ends can be provided. The ends can have any configuration suitable for attachment to the structure.

Figure 7:
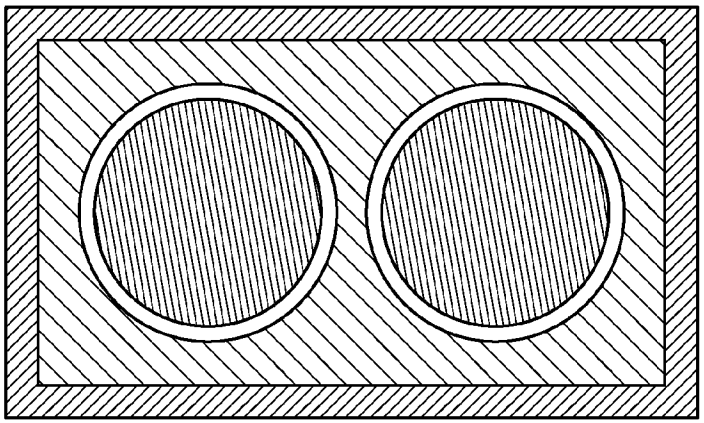
FIG. 7 is a cross sectional view of a BRB with two cores of circular cross section.

In another embodiment, a plurality of cores may be provided within a single casing. FIG. 7 illustrates two cylindrical solid cores, each surrounded by an unbonding layer, housed in a single casing having a rectangular cross section. The space between the cores with unbonding layers and the casing is preferably filled with a filler material, as described above. A suitable transition (not shown) between the ends of the cores to a connecting fitting to the structure is provided.

Figure 8:
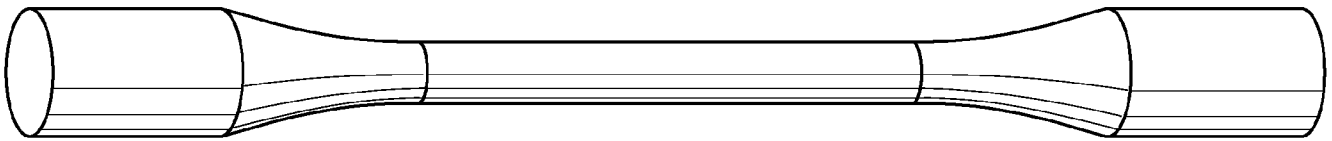
FIG. 8 is a plan view of a BRB core having a reduced cross section gauge section.

FIG. 8 illustrates an embodiment of a core having a dog bone or hourglass shape. A core with a reduced gauge section deforms preferentially within the section under tensile or compressive loading, because the stress being supported at a given point is inversely proportional to the structural member's cross-sectional area. Thus, a physical reduction in cross-sectional area may be used in addition to the differential heat treating described above in order to achieve the goal of creating strong ends with a lower yield strength mid-section.

In another embodiment, the composition of the inner deforming core may be structurally modified along its length to strengthen its ends more that its gauge section. For example, a functionally gradient structure with a core of varying material or alloy composition can be provided or a composite structure can be built with varying degrees of reinforcement along its length. Also, a hybrid metal core/composite casing BRB may be provided in which the buckling restraint casing is a filament wound composite, for example, glass fiber/vinyl ester composite shell. The space between the outer casing and the unbonding layer is filled with a castable composite material.

Figure 9:
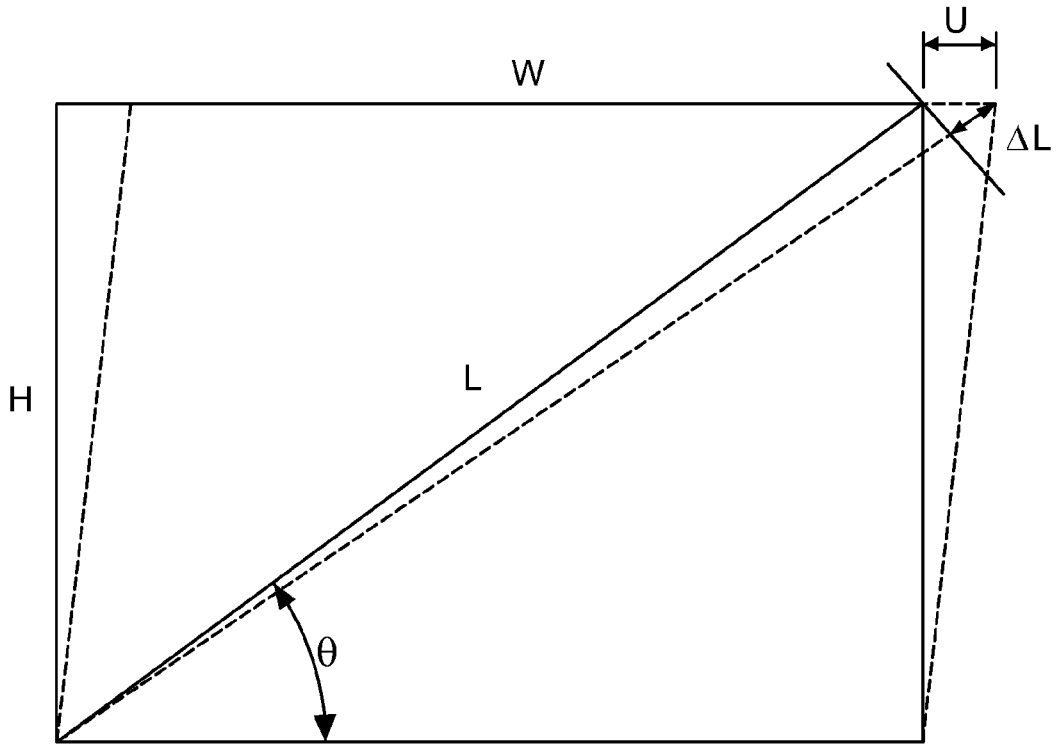
FIG. 9 is a schematic illustration of frame deformation with a single diagonal brace.

FIG. 9 illustrates a schematic of a frame of height H and width W with a single diagonal brace of length L. When the frame is subjected to a deformation U, the inter-story drift δ is defined as:

$$\delta = \frac{U}{H},$$

the corresponding diagonal deformation is:

$$\Delta L = U\cos\theta = H\delta\cos\theta$$

and the total diagonal strain:

$$\frac{\Delta L}{L} = \delta\sin\theta\cos\theta = \frac{\delta\sin 2\theta}{2}$$

Key design parameters for the brace include maximum force capacity and damper stroke (peak-to-peak in a load cycle). The higher the brace stroke capacity, the larger the inter-story drift that it is able to accommodate, and the more severe the earthquake which may be mitigated. When deformed past its yield strength, a brace returns stress-strain hysteresis curves such as the curves shown in FIGS. 10, 11, and 12, described further below. The shape of the hysteresis curves depends upon the physical characteristics of the brace and is bounded by its maximum load and stroke capacities.

To produce the BRB, the core is differentially heat treated to provide strong end sections and a gauge section with a yield strength lower than a yield strength of the end sections. The increased strength of the end sections, which are mechanically connected to the structure, compensates for weakening due to the mechanical connections, allowing any subsequent deformation to concentrate in the gauge section.

The differential heat treatment provides a functionally graded material transition between the lower yield strength middle gauge section and the higher yield strength ends, in which the gauge section has a different microstructure than the ends. This functionally graded (also called functionally gradient) material results from the temperature gradient that exists inherently between hot and cold sections of the core during differential heat treatment and which creates a gradual microstructural transition between softened and hardened zones of the core. Having a gradual functionally graded transition allows increased brace performance by minimizing stress concentrations within the deforming material. A yield strength gradient is effectively achieved via microstructural changes within this region rather than via a physical reduction in cross-section. A gradual functionally graded transition also permits the deforming gauge length to be maximized.

For example, during heating of a metal alloy, a second phase goes into solution, and then precipitates out during cooling. The size of the resulting clusters of the second phase affects the yield strength of the resulting material. As is known in the art, heat treatment can be optimized to reach an optimum grain size or second phase cluster size for optimum mechanical properties. Continued heat treatment can thus overage the material, resulting in a drop in mechanical properties such as yield strength, as in the present invention.

Any heat-treatable metal alloy can be used for the core, such as a heat-treatable aluminum or steel. The heat treatment is determined based on the material of the core and the desired yield strength of the gauge sections and the ends. The particular heat treatment can be readily determined for a particular alloy by those of skill in the art, for example, using readily available published data.

In one embodiment, the gauge section is softened by an over-aging heat treatment while the ends are kept cool to preserve their high yield strength, suitable, for example, when using 2024 aluminum. The gauge section can be heated in any suitable manner, such as by application of a number of band heaters that wrap around the core or cylindrical or semi-cylindrical heaters that extend along a length of the core. The ends can be held at a cooler temperature, such as by immersion in water or with attached heat sinks.

In an alternative embodiment, the ends are age hardened by an appropriate temperature treatment while the gauge section is kept cooler to preserve a lower yield strength. This method is suitable, for example, when using 6061 aluminum. In this case, the ends can be heated by, for example, application of band heaters, while the gauge section is kept cooler by, for example, immersion in water.

Heat treatment of materials such as aluminum is generally not suitable for fatigue applications experiencing low amplitudes and a large number of cycles. Materials such as aluminum, with high stacking fault energies, have high dislocation mobility and cross-slip easily. Thus, such materials are cyclically "history independent," in that they develop a dislocation structure and therefore a cyclic stress-strain curve that is independent of their initial strength and dislocation structure. Thus, the present invention is more advantageous for applications in which the number of cycles is limited and the strain amplitude is large, such as earthquakes and blasts from explosions.

Example 1

Figure 10:
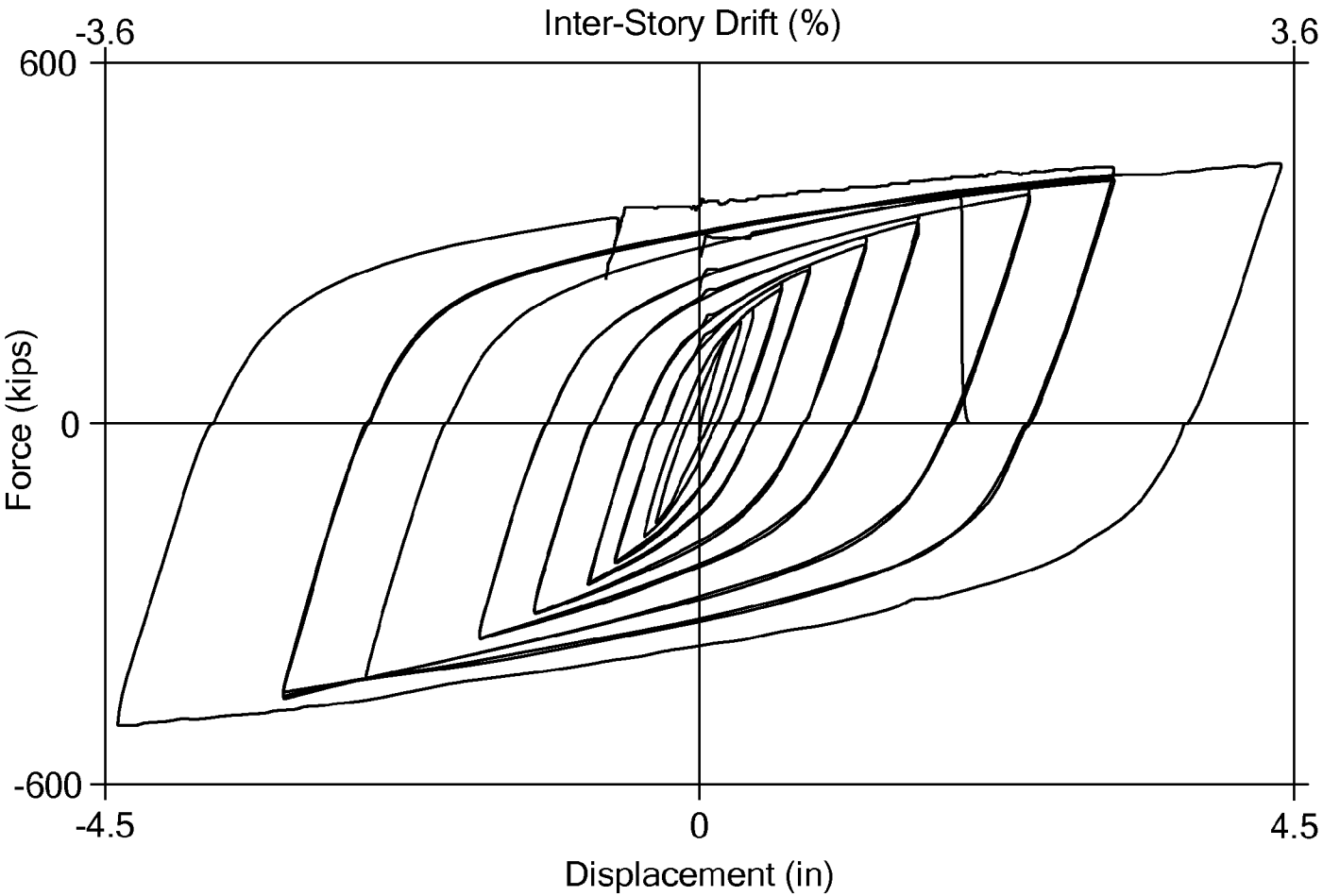
FIG. 10 is a load displacement hysteresis curve illustrating displacement or inter-story drift vs. force for a tension-compression cycling sequence of a 2024 aluminum core BRB according to the present invention.

A high capacity 2024 aluminum core, steel casing brace has been produced by differential heat treatment according to the invention. Using a core of 2024-T3 aluminum, the mid section was heated at 550 to 700° F. for 7 to 8 hours. The brace was tested in fully reversed tension-compression cycling. The testing sequence consisted of multiple cycles starting at low imposed displacements and increasing progressively to extremely high deformation (up to ±3.5% equivalent inter-story drift). See FIG. 10. This test demonstrates the capability of the present BRB to withstand deformations which would be imposed by a high magnitude earthquake. FIG. 10 shows that the BRB of the present invention subsequently survived multiple additional cycles at ±2.5% equivalent inter-story drift before ultimate failure.

Example 2

A high capacity 6061 aluminum core, steel casing brace has been produced by differential heat treatment as in Example 1. The brace was tested in fully reversed tension-compression cycling to extremely high strains (up to ±3.5% equivalent inter-story drift) plus multiple additional cycles at ±2.5% equivalent inter-story drift before ultimate failure. See FIG. 11.

Example 3

In another example, a 6061 aluminum core brace was produced, in which the ends of the core were heated at ~370° F. for approximately 7 hours. The gauge section was held at a cooler temperature. The brace was tested in fully reversed tension-compression cycling.

Figure 11:
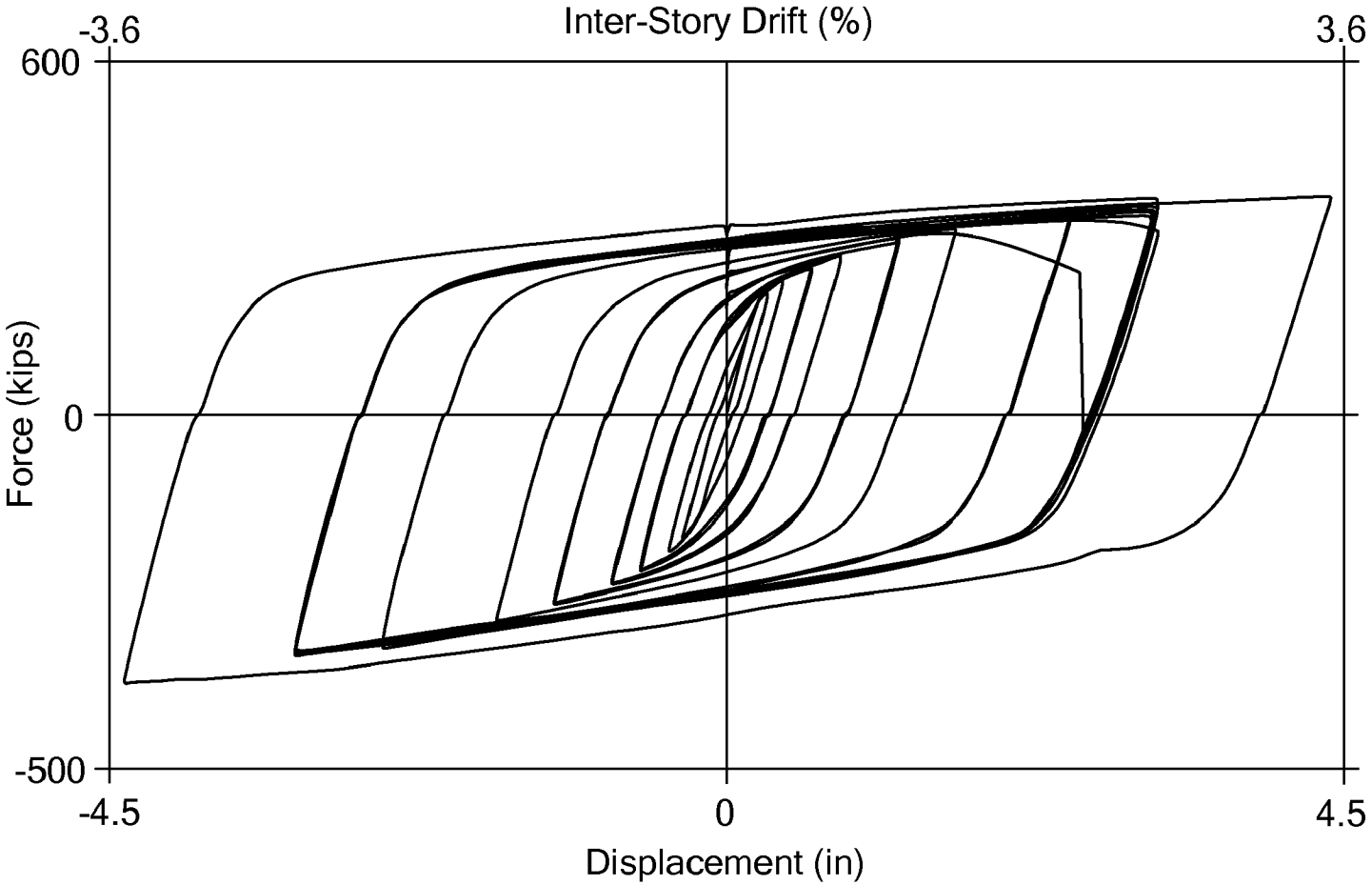
FIG. 11 is a load displacement hysteresis curve illustrating displacement or inter-story drift vs. force for a tension-compression cycling sequence of a 6061 aluminum core BRB according to the present invention.
Figure 12:
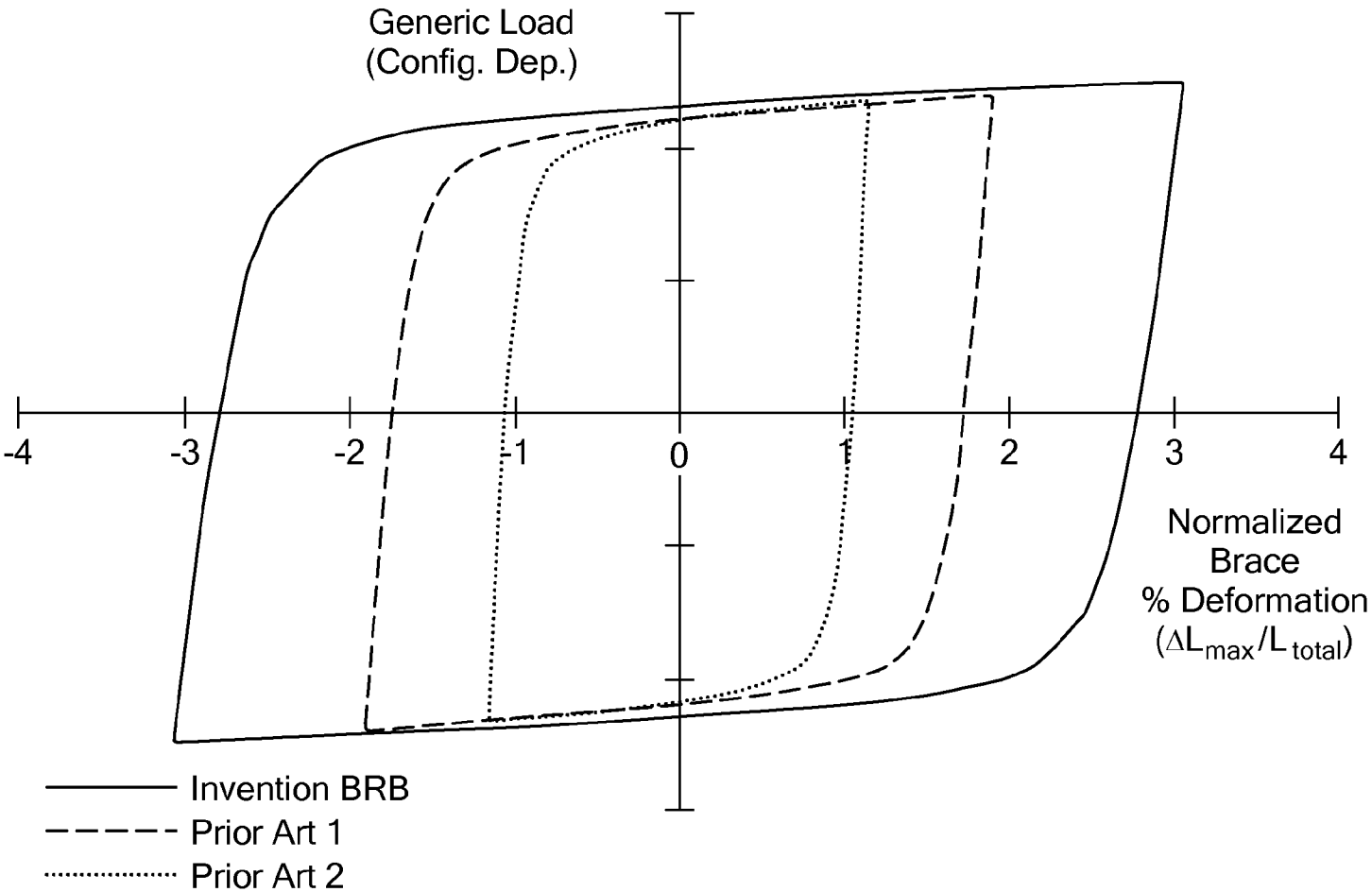
FIG. 12 is a load displacement hysteresis curve illustrating a comparison of maximum demands on a brace of the present invention compared to prior art braces.

FIG. 12 illustrates a comparison between demonstrated capabilities of different earthquake brace designs in fully reversed tension-compression loading. Maximum brace performance is plotted as percent deformation normalized by each respective brace's total installed length, i.e. including length of deforming core (gauge length) plus all transition sections, end fittings, and attachments to a building's steel frame. FIG. 12 shows that braces of the present invention have demonstrated strain capabilities (as shown in FIGS. 10 and 11) on the order of 50% to 100% greater than prior art, the latter being representative of braces in commercial use having a steel deforming core with cruciform cross-section and a concrete-filled steel casing.

The energy dissipating brace of the present invention is readily amenable to retrofit applications for steel frame buildings, most suitably for buildings of modest to medium height (three to twenty stories).

The present invention is also advantageous, because no reduction in the cross-sectional area is necessary to concentrate all the deformation in the gauge section. Foregoing a machining step to reduce the cross-section results in a brace that is more readily manufactured at less expense. It will be appreciated, however, that a reduction in cross-sectional area of the gauge section can be used in combination with differential heat treatment to soften the gauge section relative to the ends if desired.

The invention is not to be limited by what has been particularly shown and described, except as indicated by the appended claims.

What is claimed is:

1. A method of forming a buckling restrained brace comprising:

providing an elongated core having an intermediate section extending between two ends;

differentially heat treating the intermediate section from the ends, to produce a gauge section in the intermediate section having a yield strength that is lower than a yield strength of the ends;

covering the core between the ends with an unbonding layer; and inserting the core into a casing with the ends of the core extending beyond ends of the casing.

2. The method of claim 1, wherein the intermediate section is heated while the ends are held at a cooler temperature to produce the gauge section.

3. The method of claim 2, wherein the intermediate section is heated to at least 500° F. for at least five hours.

4. The method of claim 1, wherein the ends are heated while the intermediate section is held at a cooler temperature to produce the gauge section.

5. The method of claim 4, wherein the ends are heated to at least 350° F. for at least five hours.

6. The method of claim 1, wherein the core is covered with the unbonding layer by wrapping the core with a layer of metal foil.

7. The method of claim 6, wherein the metal foil is comprised of aluminum.

8. The method of claim 1, further comprising filling a volume between the casing and the unbonding layer with a filler material.

9. The method of claim 8, wherein the filler material is comprised of concrete or a composite material.

10. The method of claim 1, further comprising forming the ends of the core to provide mechanical attachment portions for attachment to a structure.

11. The method of claim 10, wherein the mechanical attachment portions comprise a threaded attachment portion, a press fit attachment portion, a machined attachment portion, an interference fit attachment portion, a bolt, or a pin.

* * * * *